United States Patent [19]

Nikolaev et al.

[11] 4,438,813

[45] Mar. 27, 1984

[54] DEVICE FOR APPLYING PLUGGING MIX TO WELL WALLS

[75] Inventors: Nikolai I. Nikolaev; Lev A. Tereschenko; Arian M. Yakovlev; Vitaly I. Kovalenko, all of Leningrad; Nikolai K. Lipatov, Murmanskaya; Ruben A. Tatevosian; Mikhail Y. Titov, both of Moscow, all of U.S.S.R.

[73] Assignee: Proizvodstvennoe Geologicheskoe Obiedinenie "Tsentrogeologia", Moscow, U.S.S.R.

[21] Appl. No.: 343,284

[22] Filed: Jan. 27, 1982

[30] Foreign Application Priority Data

Mar. 25, 1981 [SU] U.S.S.R. ..... 3257101

[51] Int. Cl.[3] ..... E21B 33/138

[52] U.S. Cl. ..... 166/177; 166/285; 166/387; 175/72

[58] Field of Search ..... 166/177, 285, 286, 387; 175/72, 309, 326

[56] References Cited

U.S. PATENT DOCUMENTS

| | | | |
|---|---|---|---|
| 2,064,255 | 12/1936 | Garfield | 175/257 |
| 3,362,476 | 1/1968 | Poollen | 175/72 X |
| 3,479,829 | 11/1969 | Goodman | 166/285 X |

*Primary Examiner*—Stephen J. Novosad
*Assistant Examiner*—Joseph Falk
*Attorney, Agent, or Firm*—Murray Schaffer

[57] ABSTRACT

A device for applying plugging mix to well walls comprises installed in series and interconnected a piston having passages for the flow of a fluid and spring-biased locking members for fixing the position of the device with respect to a drilling string, and a head carrying vanes for applying plugging mix to well walls and a bit for drilling-off the mix installed at the distal end of the head. The head has passages for the flow of the fluid. The vanes are made in the form of two plates installed on opposite sides of the head at an angle with respect to its axis of rotation, the vanes being radially movable with respect to the axis of rotation. The piston, the head and the bit are of a diameter which is slightly smaller than the nominal inside diameter of the drilling string.

3 Claims, 3 Drawing Figures

DEVICE FOR APPLYING PLUGGING MIX TO WELL WALLS

BACKGROUND OF THE INVENTION

The invention relates to devices for well drilling, and more particularly, to devices for processing plugging and grouting materials and for their application to the walls within a pre-set interval of the well.

One of important reasons hampering the improvement of drilling efficiency resides in the occurrence of troublesome zones in wells associated with instability in the rocks forming the well walls or with absorption of flushing fluid. In addition to high consumption of expensive plugging materials, liquidation of troublesome zones results in considerable unproductive loss of working time and in idling of drilling equipment. Therefore much emphasis is now placed on the development of new methods and equipment for the liquidation of troublesome zones and lowering of losses caused by such troubles.

A method for the liquidation of troublesome zones using highly-concentrated dry quick-setting materials processed directly within the troublesome interval of the well improves to a large degree the efficiency of drilling, but such method is also associated with additional labour consumption mainly in connection with lowering and lifting operations. This labour effort is especially great in liquidating troublesome zones when drilling wells with the employment of removable core lifters, wherein the number of lowering and lifting operations for the drilling process proper is minimized.

Known in the art is a device for applying plugging mix to well walls which is lowered in the well on drill pipes. The device comprises an adapter designed for coupling to a drilling string, the adapter being rigidly coupled on the other side to a mud saver bucket which is made in the form of an auger carrying a bit for drilling-off plugging mix at its distal end (cf. USSR Inventor's Certificate No. 451835, Int.Cl. E 21B 33/13).

When this device is used, the main drilling bit employed for drilling the well is first withdrawn from the well, and replaced by the above-described device. Before lowering the device, a plugging material is fed into the well. All these operations result in considerable unproductive time losses, hence in lower productivity.

Known in the art is a device for applying plugging mix, comprising a pipe for accommodating the mix, which is rigidly coupled by means of an adapter to a drilling string, the pipe being sealed with a plug at the bottom during its transfer. A head and a piston are installed in series in the pipe over the plugging mix, the head and the piston being rigidly connected to one another. The head has passages for the flow of a fluid, a bit for drilling-off plugging mix, and vanes for applying the mix to the well walls. The piston has passages for the flow of the fluid and accommodates spring-biased locking members for fixing the position of the head with respect to the drilling string. The vanes of the head in this device are made in the form of a helical spiral with turns of the hand opposite to the direction of rotation of the drilling string (cf. USSR Inventor's Certificate No. 685808, Int.Cl. E 21 B 33/13). In operation of this device the plugging material is fed to a troublesome zone concurrently with the device for its processing and application to the well walls.

However, the employment of this device also results in additional time losses associated with the head to withdraw the main drilling implement from the well and to replace it with devices for applying plugging mix together with plugging mix.

As mentioned above, such time losses are especially important in drilling wells with the employment of a removable core lifter when the whole drilling string is only withdrawn from the well in case it is required to replace the worn drilling bit.

It is an object of the invention to improve the efficiency of drilling, that is to reduce time losses for unproductive operations.

SUMMARY OF THE INVENTION

According to the present invention a device for applying plugging mix to well walls is provided, comprising, in series and interconnected, a piston having passages for the flow of a flushing fluid and spring-biased locking members for fixing the position of the device with respect to a drilling string, and a head carrying vanes for applying plugging mix to well walls and a bit installed at the distal end of the head for drilling-off plugging mix, the head having passages for the flow of the fluid communicating with the piston passages, wherein according to the invention, the vanes comprise two plates installed on opposite sides of the head at an angle to the axis of rotation, the vanes being radially movable with respect to the axis of rotation, the piston, the head, and the bit being of a diameter slightly smaller than the nominal inside diameter of the drilling string.

The head preferably has radially extending through passages or chambers coaxial to each other and communicating with the head passages for the flow of a fluid, the radially extending passages or chambers accommodating spring-biased pistons coupled to respective vanes for radially displacing the vanes.

This arrangement is most simple.

The piston and the head are preferably interconnected by means of a bar having an axial passage.

The interconnection of the head and piston by means of the bar lowers the weight of the device.

BRIEF DESCRIPTION OF DRAWINGS

The invention will now be described with reference to a specific embodiment illustrated in the accompanying drawings, in which.

DESCRIPTION OF THE INVENTION

Figure 1:
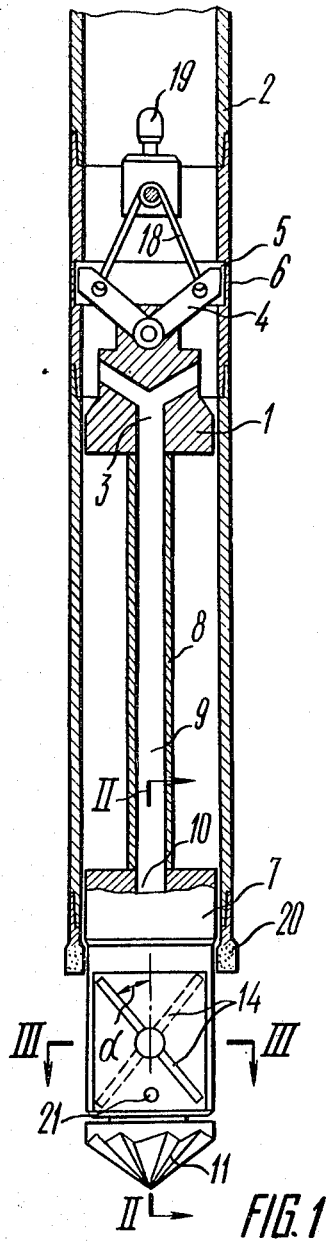
FIG. 1 shows a longitudinal section of a device for applying plugging mix to well walls according to the invention.

A device for applying plugging mix to well walls comprises a piston (FIG. 1) of a diameter corresponding to the inside diameter of a drilling string 2, the piston being designed for the transfer of the device along the drilling pipes toward the well bottom. The piston 1 has passages 3 for the flow of a flushing fluid and is provided with spring-biased locking members 4 cooperating with annular grooves 5 of a section 6 of the drilling string 2. The piston 1 is coupled with its lower portion to a head 7 by means of a bar 8 having an axial passage 9 communicating with the passage 3 of the piston 1 and with a passage 10 of the head 7. The lower portion of the head 7 terminates in a bit 11 installed under a throttle valve 12 (FIG. 2) which is installed in the passage 10 of the head 7 and which serves for preventing the fluid from getting to the passage 10, 9 and 3 (FIG. 1) from the extratube space. The bit 11, the head 7, and the piston 1 are of a diameter slightly smaller than the nominal inside diameter of the drilling string 2.

Figure 2:
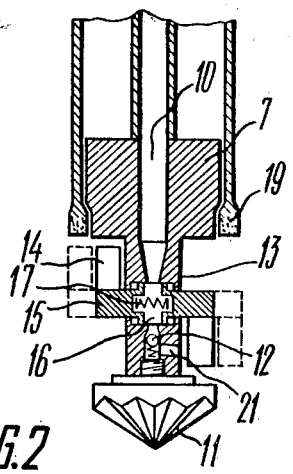
FIG. 2 is a sectional view taken along the line II—II in FIG. 1.
Figure 3:
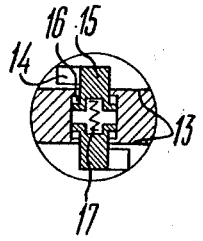
FIG. 3 is a sectional view taken along the line III—III in FIG. 1.

The head 7 has at its diametrically opposite sides longitudinal grooves 13 (FIG. 2) in which are accommodated vanes 14 made in the form of plates also shown at 14, the plates extending at an angle $\alpha$ with respect to the longitudinal axis of the device and serving for applying a plugging material to the well walls. The plates 14 are rigidly secured to pistons 15 (FIGS. 2 and 3) which are installed in radially extending through passages 16 of the head 7 communicating with the passage 10 (FIG. 2). The pistons 15 are interconnected by means of a tie-up spring 17.

A spring 18 (FIG. 1) of the locking members 4 provided in the piston 1 is connected to a pin 19 designed for engagement with an overshot (not shown) for extraction from the drilling string 2. A main drilling bit 20 is attached to the drilling string 2.

The device for applying a plugging material to well walls functions in the following manner.

In case manifestations of a troublesome zone are detected, a removable core lifter is withdrawn from the drilling string 2, the drilling string is raised above the troublesome zone, and a dry plugging material is fed through the drilling string to the troublesome zone by any appropriate known method, e.g. by pouring pellets of plugging material packed in waterproof envelopes.

The device is then lowered into the drilling string 2 in which the device moves down under gravity. When the piston 1 is at the level of the section 6, the spring-biased locking members 4 engage the annular groove 5 of the section 6 so as to fix the device inside the drilling string in such position with respect thereto that a part of the head 7 extends beyond the main drilling bit 20. The plates 14 are in the retracted position under the action of the tie-up spring 17 and extend below the main drilling bit 20.

Subsequently water is pumped through the drilling string 2, and the water flowing through the passages 3, 9 and 10 gets to the throttle valve 12 and, passing through the radially extending passage 16 acts on the pistons 15 to displace the plates 14 into the working position so that the outer edge of each plate extends in flush with the outlines of the main drilling bit. The valve 12 maintains a pressure required to hold the plates 14 in the working position in the passages 3, 9 and 10, and an excess of water is throttled and drained through passages 21 (FIGS. 1, 2) into the well for mixing with the plugging material.

When the whole drilling string 2 is caused to rotate, the bit 11 tears the envelope of the plugging mix and stirs the plugging material with water in cooperation with the plates 14. The plates 14 project the plugging mix against the walls of the well under the action of centrifugal forces so as to force the mix into voids and cracks concurrently with squeezing of excess water out of the mix. As the device continues to penetrate, the main drilling bit 20 shapes the well walls by cutting-off the excess of plugging material and restoring the well diameter.

After the plugging is over, the water pumping is stopped, the pressure in the system drops, and the plates 14 are retracted into the grooves 13 of the head 7 under the action of the tie-up spring 17.

An overshot is lowered by means of a rope through the drilling string 2 to engage the pin 19 coupled to the spring of the locking members 4 so as to disengage the locking members 4 from the annular grooves 5 of the section 6, and the device is then withdrawn from the drilling string 2.

The employment of the device according to the invention reduces the time of liquidation of troublesome zones, improves quality and stability of plugging and ensures savings.

We claim:

1. A device for applying plugging mix to well walls to be installed in a drilling string comprising: a piston of a diameter which is slightly smaller than the nominal inside diameter of said drilling string; passages for the flow of a fluid in said piston; spring-biased locking members for fixing the position of said device with respect to said drilling string, installed on said piston; a head installed coaxially with said piston and rigidly coupled thereto; passages for the flow of the fluid in said head communicating with said passages of said piston; vanes for applying a plugging mix to walls of said well, said vanes being made in the form of plates installed on opposite sides in said head at an angle with respect to its axis of rotation, the vanes being radially movable with respect to the axis of rotation; a bit for drilling-off the plugging mix, said bit being installed at the distal end of said head; said head and bit being of a diameter which is slightly smaller than the nominal inside diameter of said drilling string.

2. A device according to claim 1, wherein said head includes radially extending through chambers coaxial with each other and communicating with the passages of the head for the flow of the fluid, said radially extending chambers accommodating spring-biased pistons coupled to said respective vanes for radially displacing the vanes.

3. A device according to claim 1, wherein said piston and said head are interconnected by means of a bar having an axial passage.

* * * * *